US006345396B1

(12) United States Patent
Schuler

(10) Patent No.: US 6,345,396 B1
(45) Date of Patent: Feb. 12, 2002

(54) BUTTOCKS AND TAIL BONE PROTECTOR

(76) Inventor: Jason Schuler, 4 Seymour Avenue, Toronto, Ontario (CA), M4J 3T4

( * ) Notice: Subject to any disclaimer, the term of this patent is extended or adjusted under 35 U.S.C. 154(b) by 0 days.

(21) Appl. No.: 09/213,277

(22) Filed: Dec. 17, 1998

(51) Int. Cl.[7] ..... A41D 13/00
(52) U.S. Cl. ..... 2/467; 2/465
(58) Field of Search ..... 2/455, 456, 467, 2/44, 46, 51, 227, 267

(56) References Cited

U.S. PATENT DOCUMENTS 2,621,327 A * 12/1952 Amoroso ..... 2/455
4,151,613 A * 5/1979 Rhee ..... 2/2
4,689,829 A * 9/1987 Kaplan ..... 2/46
4,735,423 A * 4/1988 Foss ..... 2/46
4,807,301 A * 2/1989 Ferber ..... 2/2
4,837,859 A * 6/1989 Hamberg ..... 2/2
4,894,869 A * 1/1990 Boll ..... 2/400
5,038,408 A * 8/1991 DeBaene ..... 2/23
5,241,706 A * 9/1993 Netz ..... 2/66
5,619,747 A * 4/1997 Boisclair et al. ..... 2/465
5,626,895 A * 5/1997 Soverign ..... 2/467
5,652,956 A * 8/1997 Hoshizaki et al. ..... 2/22

* cited by examiner

*Primary Examiner*—John J. Calvert
*Assistant Examiner*—Tejash Patel

(57) ABSTRACT

Protective sports gear includes a buttocks and tail bone protector which is secured to a user of the gear by means of an adjustable waist band and a pair of leg bands.

8 Claims, 5 Drawing Sheets

BUTTOCKS AND TAIL BONE PROTECTOR

FIELD OF THE INVENTION

The present invention relates to sports gear specifically designed to protect the buttocks and tail bone of a person using the gear.

BACKGROUND OF THE INVENTION

People who are taking up sports such as snowboarding and rollerblading take some very hard falls particularly during the learning stages of the sport. There are currently available wrist, elbow and knee pads which are particularly useful for rollerbladers. These particular pads protect against forward falls.

For snowboarding there is a much greater tendency to fall rearwardly to a sitting position. This also happens in rollerblading but to a lesser extent.

The only thing that is currently available in the snowboarding field to protect against tail bone injuries is full pants with a reinforced region in the backside of the pants. However, this reinforced region is designed more to be tear resistant and waterproof rather than being a protector for the user of the pants.

SUMMARY OF THE INVENTION

The present invention provides protective sports gear particularly useful for snowboarding. The gear comprises a buttocks and tail bone protector with a waist band and separate leg bands for user mounting of the protector.

According to an aspect of the invention, the protector includes a curved hard shell and a soft pad over the hard shell.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
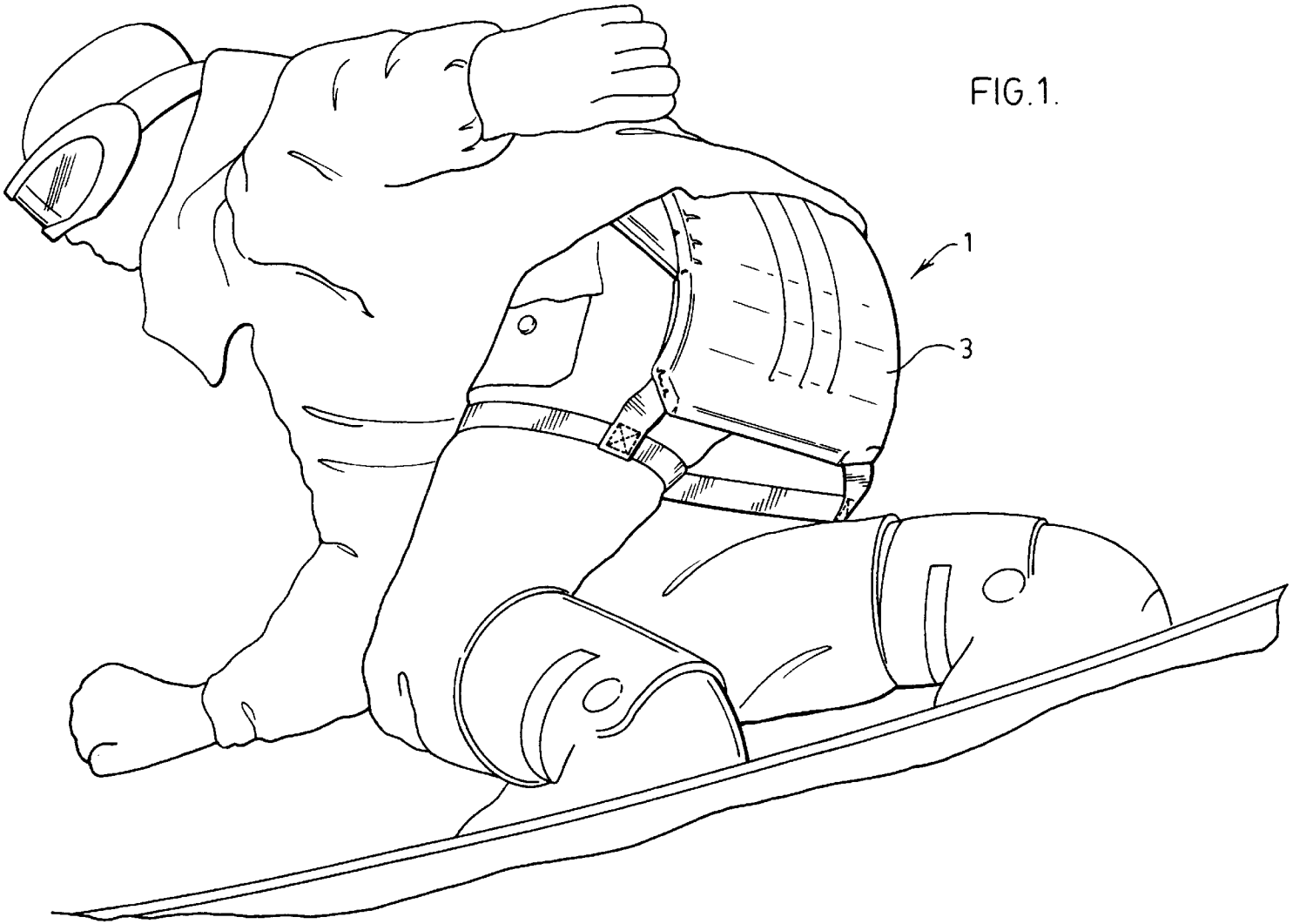
FIG. 1 is a perspective view of a snowboarder using protective sports gear according to a preferred embodiment of the present invention.
Figure 2:
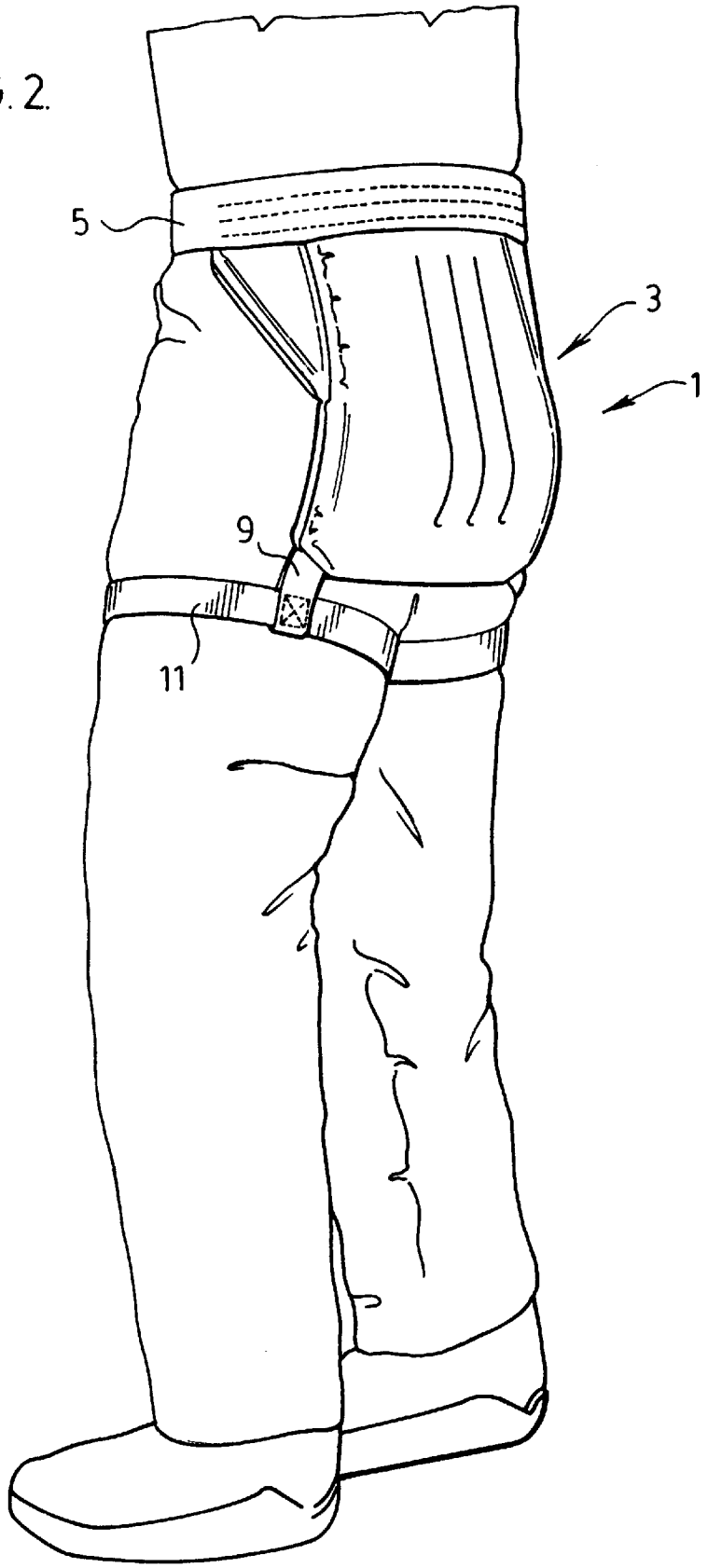
FIG. 2 is a further perspective view of the protective sports gear of FIG. 1 mounted to a user.
Figure 3:
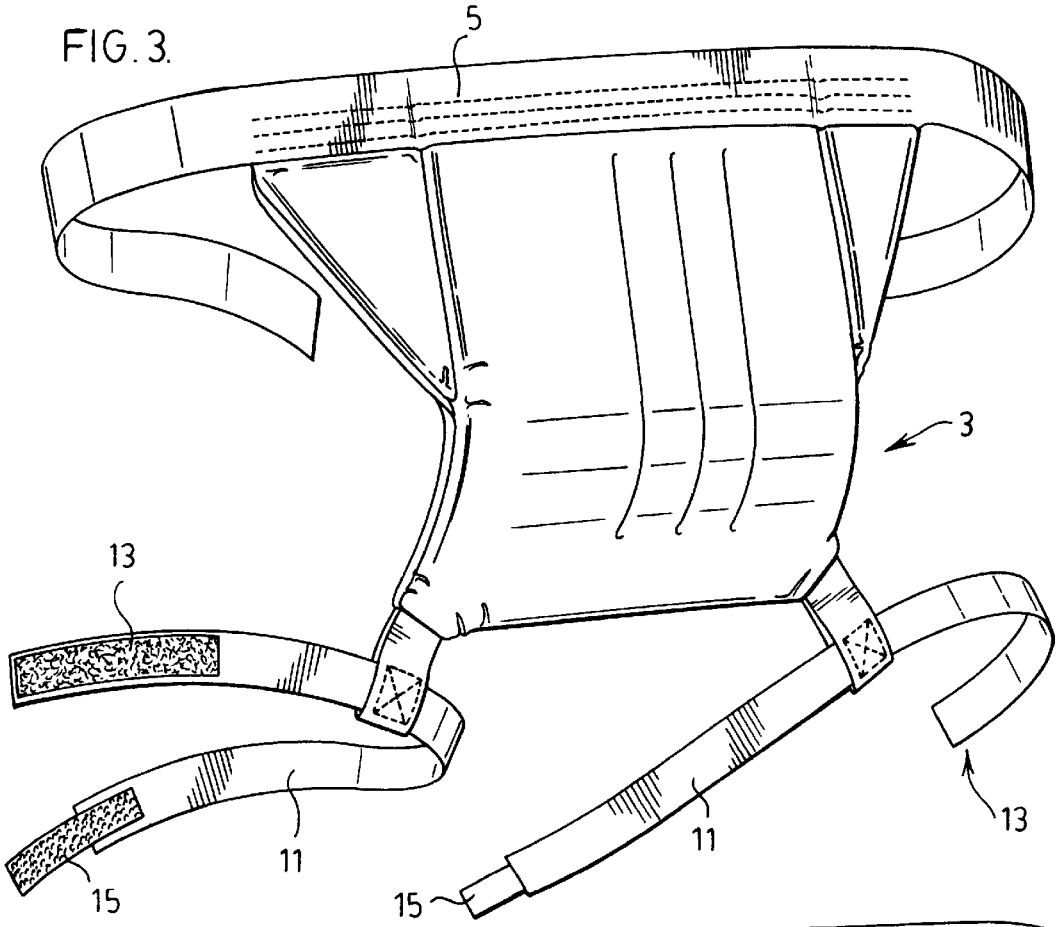
FIG. 3 is an enlarged rear prospective view of the protective sports gear of FIGS. 1 and 2.

FIG. 1 shows an individual on a snowboard using protective sports gear generally indicated at 1 according to a preferred embodiment of the present invention. This protective sports gear comprises a buttocks and tail bone protector 3 which is secured to the user by a waist band 5 (seen in FIG. 2) and a pair of leg bands 11.

Waist band 5 preferably has a none stretch woven type construction. This type of construction ensures a solid mounting to the waist of the user.

Figure 4:
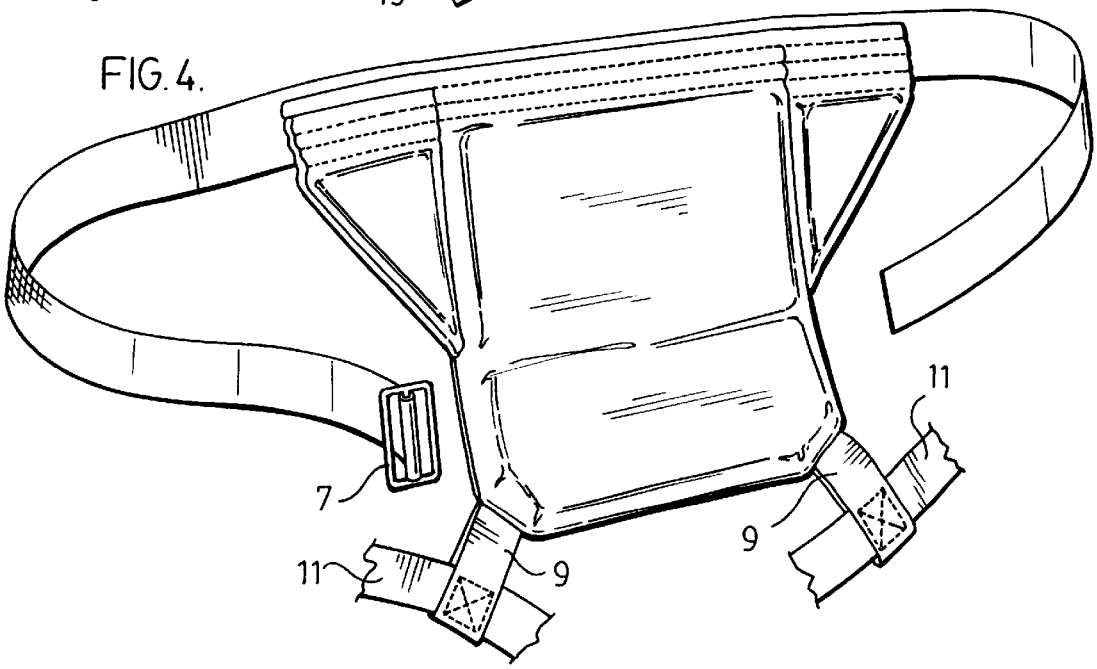
FIG. 4 is an enlarged front perspective view of the protective sports gear of FIG. 3.

In order to provide for adjustment to different waist sizes, band 5 is provided with some type of adjustment means such as slide buckle 7 best seen in FIG. 4 of the drawings.

As will be appreciated, other adjustment systems could be used in lieu of buckle 7.

Unlike the non-stretch construction of the waist band, leg bands 11 preferably have an elasticized construction. These leg bands in the embodiment shown are attached to the buttocks and tail bone protector 3 by means of loops 9 through which the leg bands are secured. Loops 9 also preferably have an elastic construction.

The elasticity of the leg bands is of benefit in that it does not impair leg movement of the user.

The leg bands are again provided with length adjustment means and, in this case, the leg adjustment means is in the form of VELCRO Loop and loop fasteners 13 and 15 on the two leg bands. Again, other types of fasteners could be used.

Figure 5:
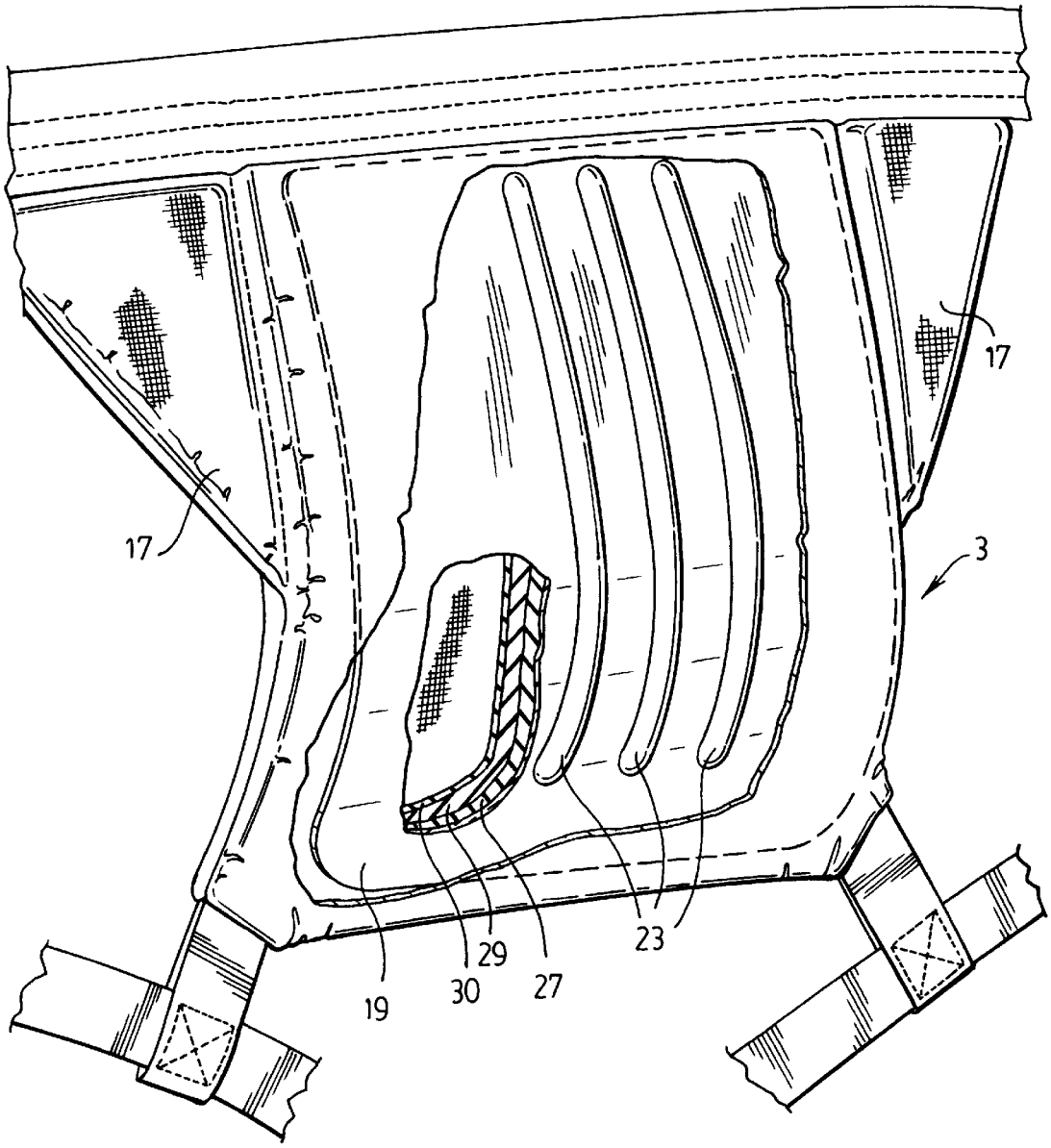
FIG. 5 is a further enlarged rear perspective view of the protective sports gear with portions cut away to show details of the buttocks and tail bone protector.
Figure 6:
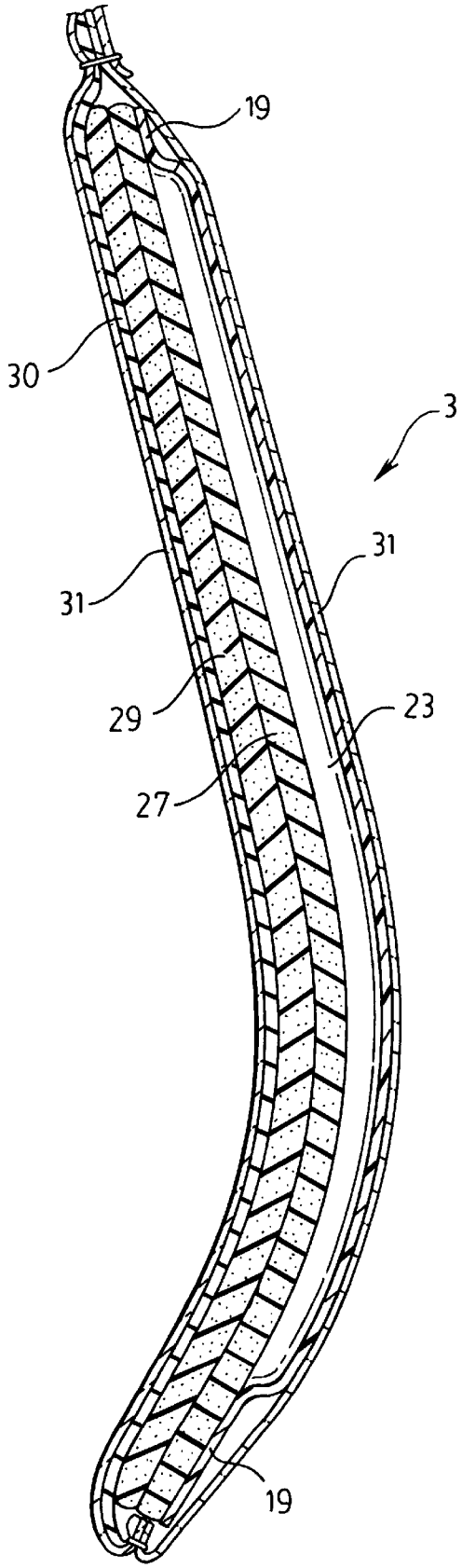
FIG. 6 is a vertical section view of the buttocks and tail bone protector of the protective sports gear of FIG. 5.

Buttocks and tail bone protector 3 is designed with both user comfort and safety in mind. Again, in the preferred embodiment and as best seen in FIGS. 5 and 6 of the drawings, the protector includes a hard shell 19. This shell is curved downwardly forwardly along its length to match the natural contour of the buttocks and to curve beneath the tail bone.

The hard shell which preferably is made from a relatively rigid plastic which will not shatter under impact is formed with ribs 23 which help to strengthen the shell.

Provided forwardly of shell 19 are a plurality of soft pads 27, 29 and 30. These pads which are encased with the shell within a soft cover 31 provide a graduated impact system between the user and the hard shell.

More particularly, pad 27, which is fused directly to the shell and farthest of the pads from the user, is made from a high density closed cell foam. The intermediate layer 29 is made from a medium density closed cell foam and layer 30 which lies directly against and is fused to cover 31 is made from a softer open cell foam. This combination is very effective from both a cushioning and a contouring standpoint.

Cover 31 is preferably made from a nylon or nylon like material which is both durable and relatively moisture resistant.

The protector includes a pair of flexible wings 17 to each side of the protector beneath and secured to the waist band. These wings, which are foam filled without the plastic shell, conform to the user and help to hold the protector in position over the buttocks.

As will be understood by the above, a user of gear 1 can wear normal snow pants rather than having to purchase specifically designed snowboarding pants. It is to be appreciated that, although the figures show the sports gear being worn on the outside of the snow pants, it can just as easily be worn inside the snow pants. In any event, the buttocks and tail bone protector is very effective in providing a buffer against tail bone type injuries to which snowboarders and enthusiasts of other similar sports are subject particularly when learning the sports.

Although various preferred embodiments of the present invention have been described in detail, it will be appreciated that variations may be made thereto without departing from the spirit of the invention or the scope of the appended claims.

The embodiments of the invention in which an exclusive property or privilege is claimed are defined as follows:

1. Protective sports gear comprising a buttocks and tail bone protector and a waist band and a pair of leg bands secured to said protector for user mounting of said gear, said protector comprising a rigid curved shell having resilient padding provided thereon and said leg bands being made from an elastic material.

2. Protective sports gear as claimed in claim 1, wherein said padding is encased within a soft cover.

3. Protective sports gear as claimed in claim 2 wherein said shell is ribbed.

4. Protective sports gear as claimed in claim 2 including a pair of flexible soft wings one to each side of said buttocks and tail bone protector and secured to said waist band.

5. Protective sports gear as claimed in claim 2 wherein said leg bands are secured through loops attached to said cover of said buttocks and tail bone protector.

6. Protective sports gear as claimed in claim 1 including hook and loop fasteners for adjustable length securing of said leg bands.

7. Protective sports gear as claimed in claim 1, wherein said padding comprises a plurality of foam pads.

8. Protective sports gear as claimed in claim 7, wherein said plurality of pads comprises an open cell foam pad, a closed cell medium density form pad and a closed cell high density foam pad from front to back of said protector.

* * * * *